US005844963A

United States Patent [19]

Koller et al.

[11] Patent Number: 5,844,963

[45] Date of Patent: Dec. 1, 1998

[54] ELECTRON BEAM SUPERIMPOSITION METHOD AND APPARATUS

[75] Inventors: Thomas Koller, Salt Lake City; Rajesh Bandari, Midvale; Jeff Takenaka, Salt Lake City; Rick Smith, Sandy, all of Utah

[73] Assignee: Varian Associates, Inc., Palo Alto, Calif.

[21] Appl. No.: 919,836

[22] Filed: Aug. 28, 1997

[51] Int. Cl.[6] ..... H01J 35/14

[52] U.S. Cl. ..... 378/136; 378/138

[58] Field of Search ..... 378/136, 137, 378/138, 113, 134, 135

[56] References Cited

U.S. PATENT DOCUMENTS

| | | | |
|---|---|---|---|
| 3,783,333 | 1/1974 | Atlee | 378/138 X |
| 4,065,689 | 12/1977 | Pleil | 378/138 X |
| 4,685,118 | 8/1987 | Furbee et al. | 378/138 X |
| 5,303,281 | 4/1994 | Koller et al. | 378/134 |

FOREIGN PATENT DOCUMENTS

| | | | |
|---|---|---|---|
| 0 440 532 | 8/1991 | European Pat. Off. | 378/138 |
| 0 471 627 | 2/1992 | European Pat. Off. | 378/138 |

*Primary Examiner*—David P. Porta
*Attorney, Agent, or Firm*—Bella Fishman

[57] ABSTRACT

A method and apparatus for superimposing a plurality of electron beams at a desired location after X-ray tube manufacturing processes are generally complete. The method is embodied in providing mechanical and electrical means which are internal to the X-ray tube which provide means for adjustment of a focal point of a plurality of electron beams being emitted from a cathode assembly to thereby provide precise control of where the plurality of electron beams achieve superimposition on a target anode.

22 Claims, 7 Drawing Sheets

ELECTRON BEAM SUPERIMPOSITION METHOD AND APPARATUS

BACKGROUND

1. The Field of the Invention

This invention relates generally to methods and apparati which are utilized to adjust a focal point of multiple electron beams in an X-ray tube. More specifically, a preferred embodiment of the present invention teaches modifications to X-ray tube structure which enable manipulation of the anode to cathode spacing to thereby achieve superimposition of at least two cathode electron beams at a desired location on a rotating anode. In alternative embodiments, X-ray tube modifications provide modification of the focal point of multiple electron beams through manipulation of electron beam paths using electrical fields.

2. The State of the Art

Non-invasive examination using X-rays is an important diagnostic tool. While there are obviously many medical applications, industrial uses are also ubiquitous. Consequently, improved X-ray tubes are a valuable product which can enhance effectiveness of X-ray technology in numerous industries.

In order to introduce helpful terminology, an explanation of what is typically provided in an X-ray tube and a method of operation follows. Briefly, a generator of X-rays is typically a vacuum tube which first produces an electron beam from a cathode. The electron beam is accelerated toward a high speed rotating target (the anode). The impact of the electron beam generates X-rays which pass from the vacuum tube and are directed toward an object of interest. As the X-rays are directed, they are also collimated so as to form a concentrated X-ray beam.

In standard X-ray tubes as shown in FIG. 1, it is known to superimpose two electron beams 2 onto a same focal point 4 on a spinning anode target. This focusing of electron beams 2 is accomplished using a pair of cathode cups 6 which typically utilize two and three slot designs. The slots are machined grooves which form the cups 6 that are symmetrically placed about an axis as shown. A cathode filament 8 is normally mounted in the cup 6 and adjacent to the intersection of a smallest and a next to smallest slot. When the cathode filament 8 is mounted inside of the smallest slot, its electron beam emission is diminished because of space charge effects.

In U.S. Pat. No. 5,303,281 (the '281 patent) issued to Varian Associates, Inc. and which is hereinafter incorporated by reference, it is explained that a special mammography X-ray tube was developed which is shorter in overall length than a standard X-ray tube. The tube length is a result of the desire to have an X-ray exit port as close as possible to a patient's breast to thereby obtain the highest resolution and contrast in a picture.

Disadvantageously, superimposition of multiple electron beams from adjoining X-ray tubes employing multiple cathode cups has not been possible in mammography X-ray tubes. This is because slot dimensions necessary in standard two-slot cathode cup configurations required the center of the two slots to be too far apart to allow the electron beams to become superimposed over the shorter cathode to anode distance employed in mammography tubes. Consequently, high intensity electron beams could not be provided and mammography X-ray tubes were considered to be cathode emission limited. The result was that typical mammograph examination times could range from 1–2 seconds for large spot applications, to 5 seconds for higher resolution small spot applications.

Fortunately, the '281 patent teaches a method and apparatus for an improved mammography X-ray tube which combined the ability to use a multiple cathode cup X-ray tube while taking advantage of the shorter length cathode to anode design.

It was also discovered, however, that while the improved mammography X-ray tube of the '281 patent will approximately double the cathode current as compared to a single cathode beam X-ray tube design, for very small focal spots on the order of 0.1 mm, exact X-ray beam superimposition is difficult to achieve without making the overall spot size larger than a single beam. Accordingly, adequate superimposition of X-ray beams requires alignments of at least 0.3 mm or better.

Adding to the difficulty of achieving X-ray beam superimposition are manufacturing variables. For example, during evacuation of the X-ray tube and bake out, mechanical alignments can be upset due to such factors as differential thermal expansion, atmospheric pressure, stress relief, and mechanical creep as is understood by those skilled in the art.

Consequently, it would be an improvement over the state of the art to provide a new method for adjusting a focal point of multiple cathode filaments to thereby obtain an X-ray tube capable of providing precise superimposition of electron beams and the resulting X-rays after the X-ray tube manufacturing processes are generally considered complete. It would also be an improvement to make engineering enhancements to the X-ray tube structure which would facilitate adjustment of electron beam superimposition.

OBJECTS AND SUMMARY OF THE INVENTION

It is an object of the present invention to provide a new method and apparatus for adjustment of the focal point of multiple electron beams in an X-ray tube.

It is also an object to provide a method and apparatus for adjustment of multiple electron beams which enables precise superimposition thereof.

It is a further object to provide a method and apparatus for precise superimposition of multiple electron beams through mechanical adjustment of the X-ray tube components after the manufacturing process is complete.

It is a further object to provide a method and apparatus for precise superimposition of multiple electron beams through the addition of a mechanically adjustable bellows which modifies a position of a cathode assembly relative to an anode assembly.

It is a further object to provide a method and apparatus for precise superimposition of multiple electron beams through manipulation thereof utilizing electrical fields.

It is a further object to provide a method and apparatus for precise superimposition of multiple electron beams through modification to the X-ray tube assembly by the addition of an electrode which provides an electrical field for modifying the path of at least one electron beam.

It is a further object to provide a method and apparatus for precise superimposition of multiple electron beams through modification to the X-ray tube assembly wherein the cathode cups are electrically isolated, thereby enabling modification of electrostatic fields which are applied thereto.

The present invention is realized in a method and apparatus for superimposing a plurality of electron beams at a desired location after X-ray tube manufacturing processes are generally complete. The method is embodied in providing means for adjustment of a focal point of a plurality of electron beams being emitted from a cathode assembly to thereby provide precise control of where the plurality of electron beams achieve superimposition on a target anode.

In a first aspect of the present invention, a bellows or other type of membrane is added to the cathode support structure within the X-ray tube. The addition of the bellows enables the cathode assembly to be selectively positioned closer to or further away from the anode assembly. Adjustment of cathode assembly position is accomplished through spacing screws which allow precise control over movement of a cathode support structure. Specifically, the spacing screws provide selective movement of the cathode assembly relative to an anode assembly.

Alternatively, in a second aspect of the present invention, a first focusing electrode is positioned adjacent to a first cathode focusing cup while not being adjacent to a second cathode cup, and a second focusing electrode is likewise positioned adjacent to the second cathode focusing cup while not being adjacent to the first cathode focusing cup. By electrically isolating the electrodes from the first and second cathode focusing cups, desired electrical charge can be applied so as to enable "steering" of the electron beams being emitted from the first and the second cathode focusing cups.

Alternatively, in a third aspect of the present invention, a focusing electrode is positioned between the cathode focusing cups. Application of an electrical potential thereto will selectively cause movement of the focal point of the two electron beams, causing electron beam superimposition at a location which is closer to or further from a target anode.

Alternatively, in a fourth aspect of the present invention, the first cathode focusing cup is electrically isolated from the second cathode focusing cup. By application of a potential difference therebetween, the electron beams can be focused as in the second and third aspects above.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the prior art and the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
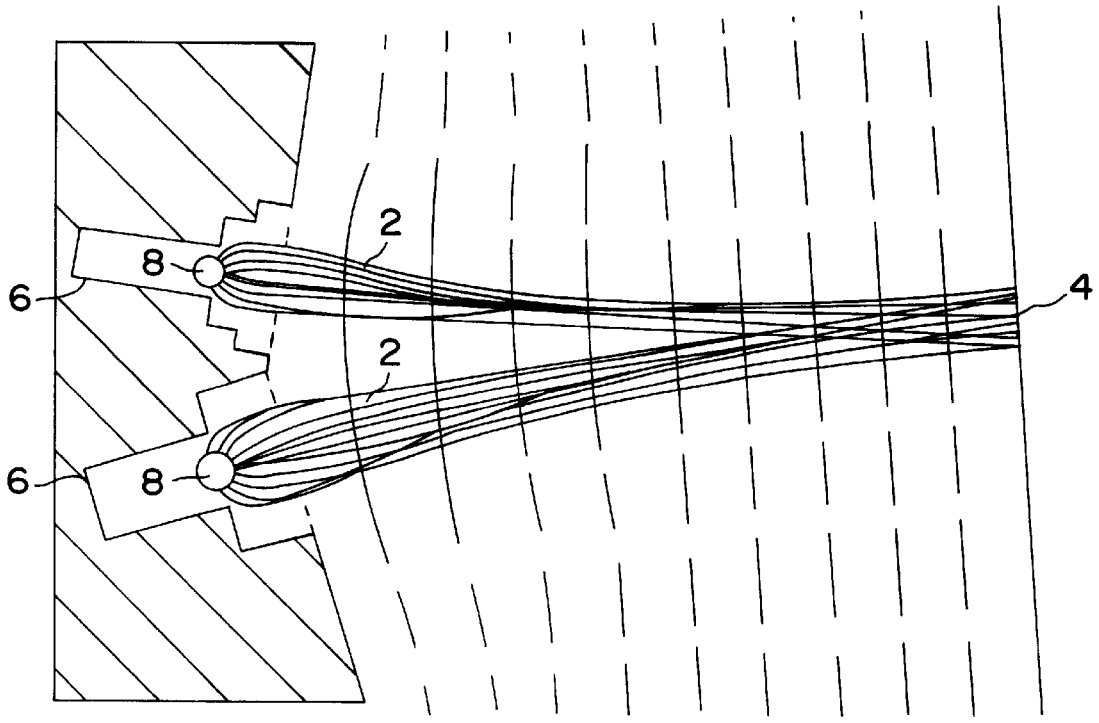
FIG. 1 PRIOR ART
FIG. 1 is a cross-sectional profile schematic of electron optics for superimposing small filament and large filament electron beams as known to those skilled in the art.
Figure 2:
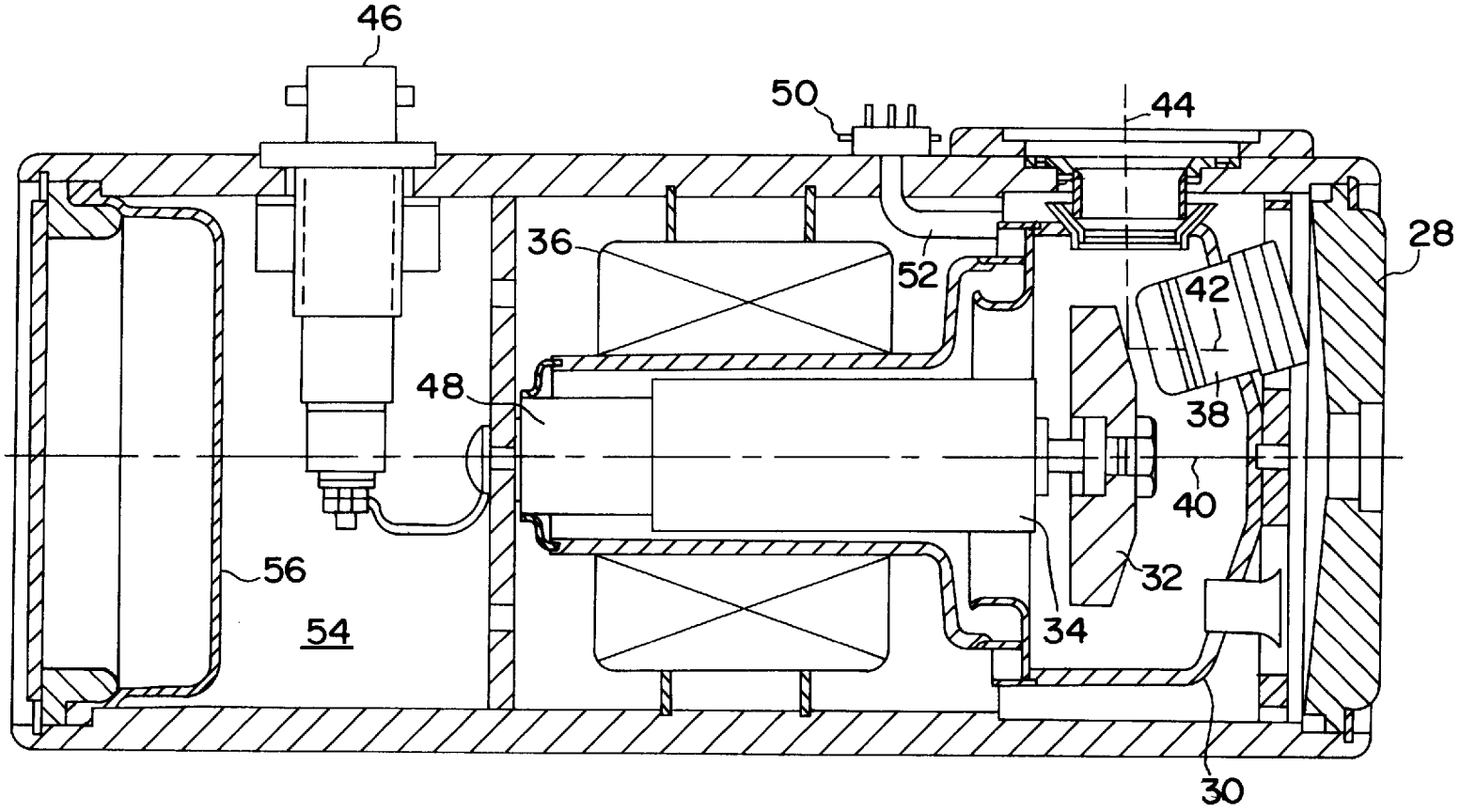
FIG. 2 PRIOR ART
FIG. 2 is a cross-sectional profile schematic of an X-ray tube commonly used in mammography as known to those skilled in the art.

Before describing the present invention, FIG. 2 is provided so as to place the cross-sectional schematic of a portion of the cathode assembly of FIG. 1 in perspective relative to an X-ray tube. As shown, the mammography X-ray tube 28 has a vacuum envelope 30 containing a rotating anode 32, and a motor rotor coil 34 for providing high speed drive power for the anode in conjunction a stator coil 36 of the motor. Cathode assembly 38 is offset from an axis 40 for providing a beam of electrons 42 which are accelerated to thereby impact the sloped surface of a target (anode 32) in a fixed rectangle line in space which provides an output rectangular X-ray beam 44. A high voltage standoff 46 connects high voltage to the anode 32 (about 25 to 30 kV) through a bearing (not shown) between a rotor support 48 and the rotor coil 34 for coupling the high voltage to the rotating anode 32 to thereby create an accelerating field between the anode 32 and the cathode 38.

A filament (not shown) within the cathode assembly 38 is supplied current from connector 50 via conductors 52. One side of each filament is normally grounded to the housing. A space 54 on the inside of the housing which is not within the vacuum envelope is filled with a dielectric oil. An elastomeric cup 56 is able to deform to accommodate temperature induced changes in the oil and thereby maintain oil pressure.

With this overall structure of the portion of the cathode assembly (electron optics) of FIG. 1 and the X-ray tube 28 of FIG. 2 in mind, it is now possible to explain the improvements provided by the following embodiments of the present invention. It should be remembered that what is ultimately desired is greater X-ray beam output concentration. This is accomplished in the present invention through increased electron beam current. Specifically, X-ray beam output is increased by precisely superimposing two electron beams at a same focal point on an anode assembly. The preferred embodiment discussed first is directed to a modification in X-ray tube structure which enables movement of the cathode assembly relative to the anode assembly.

Figure 3:
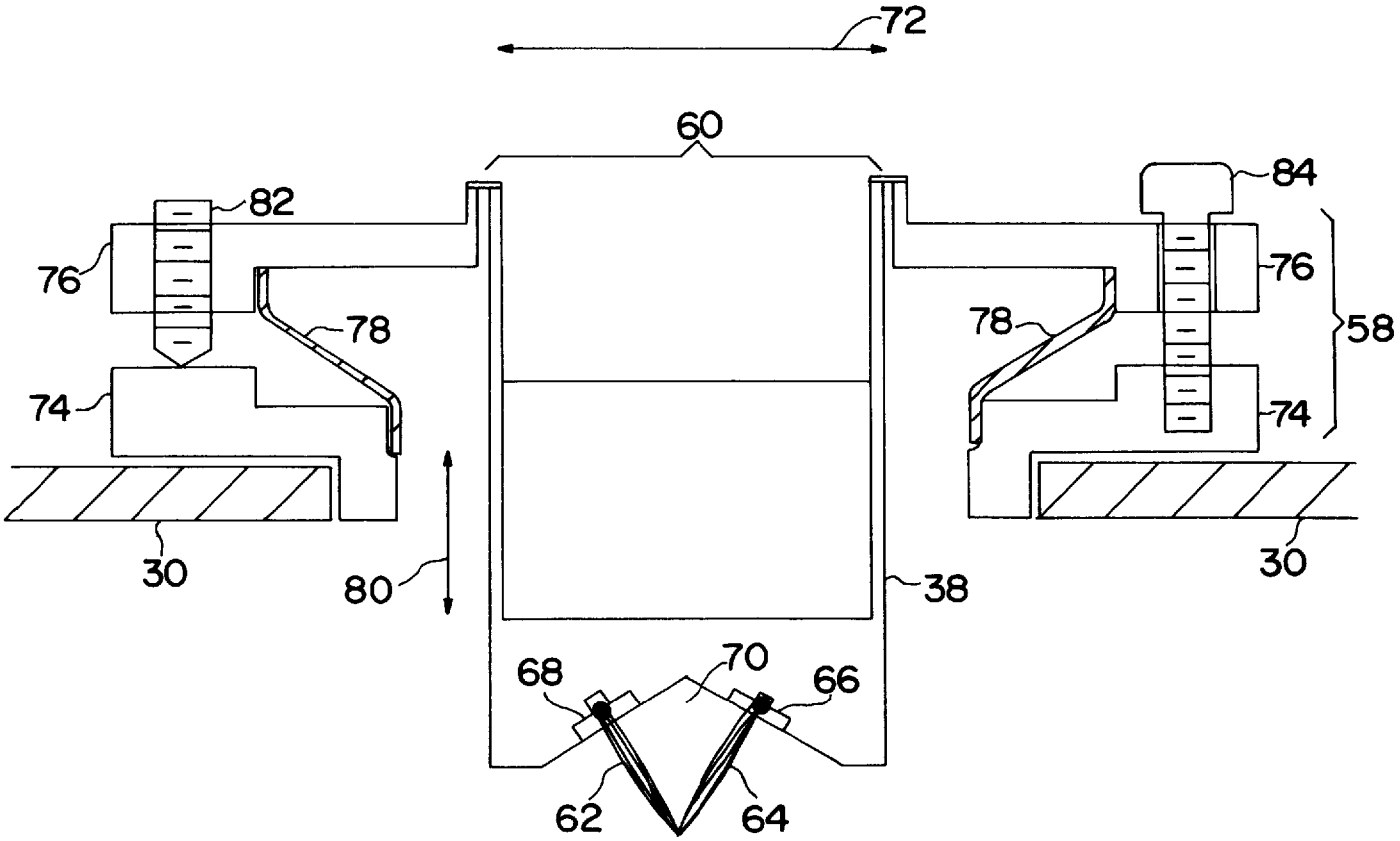
FIG. 3 is a cross-sectional profile schematic of a presently preferred embodiment constructed in accordance with the principles of the present invention, where the cathode assembly now includes an adjustable support structure for selectively positioning a cathode assembly relative to an anode assembly.

FIG. 3 is a cross-sectional schematic view of a presently preferred embodiment which is constructed in accordance with the principles of the present invention. What is shown is that a cathode assembly 38 now includes an adjustable support structure 58 for selectively positioning the cathode assembly relative to an anode assembly (not shown). Referring briefly to FIG. 2, the cathode assembly 38 is shown as being inserted partially into the vacuum envelope 30, and being supported thereby. Referring now to FIG. 3, this cross-sectional view also shows the envelope housing 30, typically constructed of copper. The cathode assembly 38 in the prior art typically consists only of the canister 60. However, one of the points of novelty of the present invention are the addition of spacing screws 82 and (84) used in the adjustable support structure 58 which are on opposite sides of the cathode assembly 38.

It should be noted that FIG. 3 shows that the cathode cups 66 and 68 are generally aligned such that their lengthwise axis 70 (shown as a point extending into the page) is perpendicular to an axis 72 formed by the spacing screws 82 and (86) in the adjustable support structure 58. It is important to realize that the orientation of the cathode assembly 38 is only shown this way for illustration purposes only. The purpose of the support structure 58 is to move the entire cathode assembly 38 as a unit either closer to or further away from the anode assembly. The cathode assembly 38 can therefore be rotated relative to the axis 72 as desired.

The adjustable support structure 58 is illustrated as being comprised of three main components. The first is a fixed support 74 which rests flush against the vacuum envelope 30. This orientation helps provide a secure seal for the vacuum within. The fixed support 74 is coupled to the vacuum envelope 30 by methods which are known to those skilled in the art to provide a secure seal, such as brazing. The fixed support 74 is a static structure which depends on being immobile. Adjustable in a position relative to the fixed support 74 is a moveable support 76. The moveable support 76 is coupled to the fixed support 74 via a membrane or bellows 78. The bellows 78 is constructed of a flexible material such as nickel, iron, stainless steel, inconel or other flexible alloys. The bellows 78 is flexible so as to provide a range of motion for the cathode assembly 38 in the directions of the arrows 80. The bellows 78 is coupled to the fixed support 74 and the moveable support 76 by brazing.

The fixed support 74, the moveable support 76, and the bellows 78 are generally formed in a circle around the cathode assembly 38. This is because the cathode assembly 38 is typically mounted in circular canister 60. On generally opposite sides of the support structure 58 are the spacing screws 82 and 84. A set or jamb screw 82 is provided opposite to a jack screw 84. By releasing (loosening) the jamb screw 82, the jack screw can be turned to thereby adjust a height of the cathode assembly 38 relative to the anode assembly along the axis 80. After completing adjustment of the jack screw 84 to obtain superimposition of electron beams 62 and 64, the jamb screw 82 is tightened to thereby secure the location of the cathode assembly 38.

A last construction detail which should be mentioned is that the moveable support 76 is obviously coupled to the cathode assembly 38. In the presently preferred mechanical embodiment, they are coupled using a heli-arc weld which also provides a vacuum tight seal. However, any other appropriate coupling method can be used.

The preferred embodiment described above provides a means for raising and lowering a height of the cathode assembly 38 relative to the anode assembly to thereby enable superimposition of the electron beams emitted from the cathode cups 66 and 68. Included in this adjustment process is the requirement to determine when superimposition of the electron beams 62 and 64 has occurred. This is typically determined by the sensing of an appropriate physical manifestation of superimposition, such as X-ray output.

It should be mentioned that while this preferred embodiment above teaches use of the fixed support 74 and the moveable support 76, either of these support structures 74 or 76 might be constructed more integrally with the existing X-ray tube structure, such as the vacuum envelope 30 and the cathode assembly 38. It is only for convenience that these support structures are shown as additional structures which are being added to the existing X-ray tube structure.

Figure 4A:
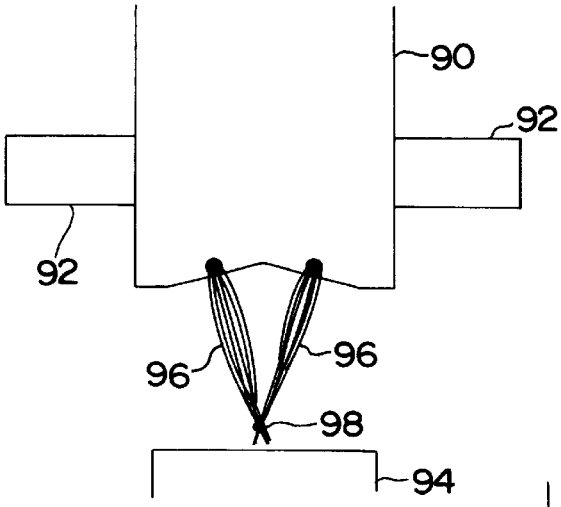
FIG. 4A is a profile view of a cathode assembly, a support structure, an anode assembly, and electrons beams which have a focal point which is not on the anode assembly.

FIG. 4A is a cross-sectional profile view of a block diagram showing a cathode assembly 90, a support structure 92, an anode assembly 94, and electrons beams 96 which have a focal point 98 which is not on the anode assembly. The unfocused focal point 98 is exaggerated for clarity.

Figure 4B:
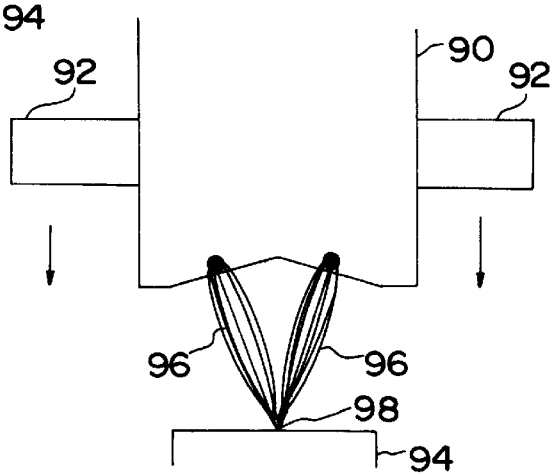
FIG. 4B is a profile view of the elements of FIG. 4A which show that the focal point of the electron beams has been adjusted so as to fall on the anode assembly utilizing the embodiment of FIG. 3.

FIG. 4B is a cross-sectional profile view of the block diagram elements of FIG. 4A which show that the focal point 98 of the electron beams 96 has been adjusted so as to fall on the anode assembly 94 using the apparatus of FIG. 3. Accordingly, in this example the cathode assembly 90 has been moved closer to the anode assembly 94.

Figure 5:
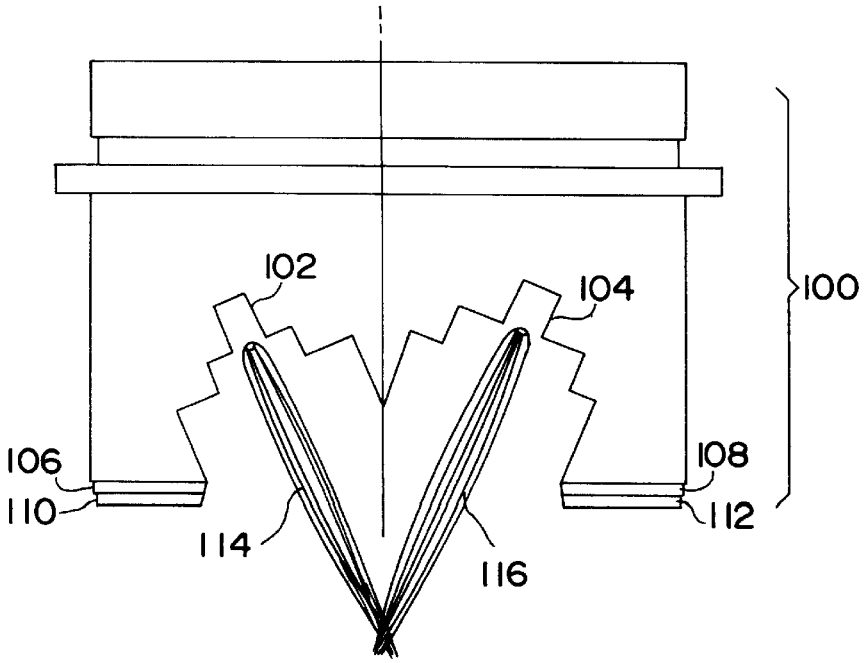
FIG. 5 is a cross-sectional profile schematic of a first alternative embodiment which illustrates electron optics of a cathode assembly, where a first cathode cup and a second cathode cup emit electron beams whose paths are altered according to the strength of adjacent electrical fields created by steering electrodes.

FIG. 5 is a first alternative embodiment of the present invention. While this alternative embodiment also requires a physical modification of the apparatus to achieve electron beam superimposition, it does not require a means for moving the cathode assembly. Alternatively, this embodiment is directed to providing a means for generating at least one electrical field which is positioned so as to be able to modify a focal point of at least one electron beam.

Specifically, FIG. 5 shows a cross-sectional view of the electron optics 100 of a cathode assembly. The electron optics 100 have been modified so that there are preferably two additional layers added to outer edges of the cathode cups 102 and 104. The first layer is comprised of insulators 106 and 108. The insulators 106 and 108 are used to insulate steering electrodes 110 and 112 from an electrical potential developed on the cathode cups 102 and 104, respectively. Because the steering electrodes 110 and 112 are isolated from the cathode cups 102 and 104, as well as from each other, each electron beam 114 and 116 being emitted from the cathode cups 102 and 104 can be steered individually, according to an electrical field generated when an electrical potential is applied to the steering electrodes 110 and 112.

Figure 6:
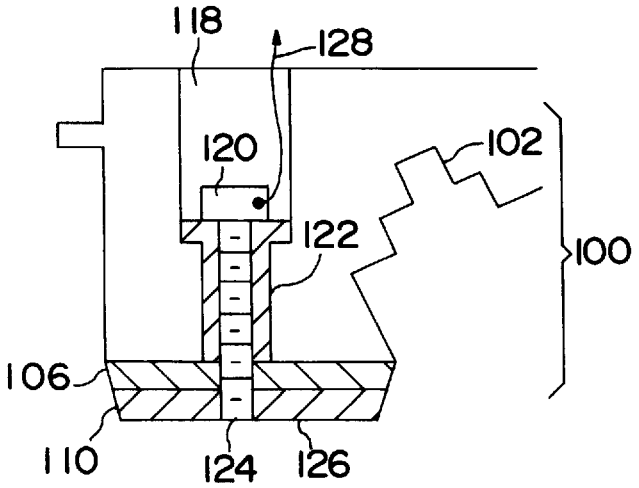
FIG. 6 is a cross-sectional profile schematic of one half of the electron optics of the cathode assembly of FIG. 5, and which shows how a screw insulated by a ceramic bushing is electrically coupled to the steering electrode and coupled to an electrical potential via an electrical lead.

FIG. 6 is provided to show in more detail how the electrical potential can be applied to the steering electrodes 110 and 112. As shown in this detail of one side of the electron optics 100, a hole 118 is bored down through the electron optics 100. An electrically conductive screw 120 has been inserted down into this hole 118. In order to electrically isolate the steering electrode 110, another insulator 122 is inserted into the hole 118 ahead of the screw 120. This insulator 122 can be, for example, a ceramic bushing. The ceramic bushing 122 only needs to extend down to the insulating layer 106 already shown as insulating the steering electrode 110 from the cathode cup 102. To minimize anomalies in the electrical field generated by the steering electrode 110, an end 124 of the screw 120 is preferably cut so as to be flush with a surface 126 of the steering electrode 110. Finally, a conductive lead 128 is shown as being attached to the screw 120 in order to provide the electrical potential to the steering electrode 110. It is noted that a same physical arrangement of components (and hole) is provided for in the other half of the electron optics 100 not shown in FIG. 6. It should be remembered that this example is only illustrative of one method of applying the electrical potential to the steering electrodes 110 and 112.

Figure 7:
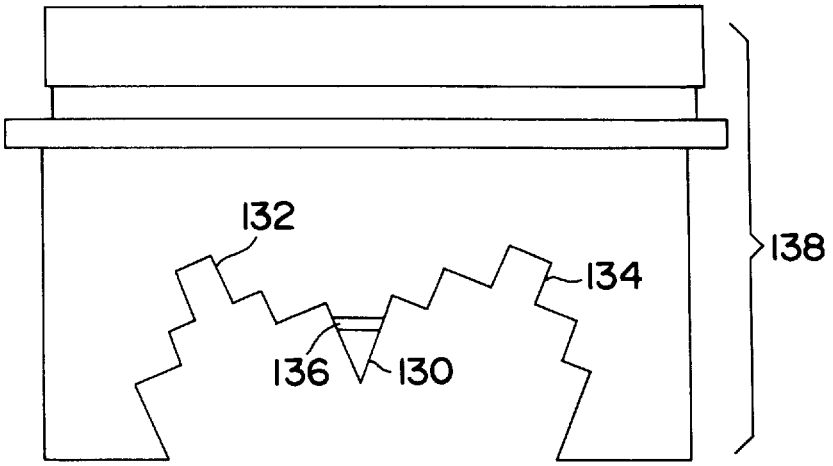
FIG. 7 is an alternative embodiment showing a cross-sectional profile schematic of the electron optics of the cathode assembly, where a single steering electrode is now disposed between the cathode cups.

FIG. 7 is another alternative embodiment of the present invention which is similar to the first alternative embodiment in that it also provides a means for generating an electrical field which can modify a path of the electron beams. This new embodiment is related to the embodiment of FIGS. 5 and 6 in that it also utilizes a steering electrode. However, it differs in that only a single steering electrode is utilized. Specifically, it is disposed between the cathode cups in the electron optics, instead of using two separate steering electrodes.

Figure 8:
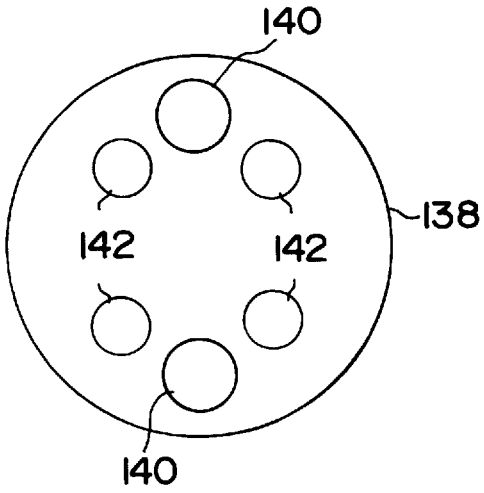
FIG. 8 is a top schematic view of a back side of the electron optics shown in FIG. 7 which shows two holes bored therethrough to enable the single steering electrode to be held in place by screws inserted therein.

FIG. 7 shows the single steering electrode 130 is formed as a portion of the wall between the cathode cups 132 and 134. It should be realized that the single steering electrode 130 can be as much or as little of the wall separating the cathode cups 132 and 134 as is desirable. Like the previous embodiment of FIGS. 5 and 6, it is also necessary to electrically isolate the single steering electrode 130. A first step is to provide an insulating layer 136 against the electron optics 138. However, FIG. 8 is provided to show how electrical energy is sent to the single steering electrode 136 in this embodiment. Two holes 140 have been bored into a back side of the electron optics 138. These holes 140 are in addition to existing holes 142 which provide electrical connections to cathode filaments (not shown) within the cathode cups 132 and 134.

Figure 9:
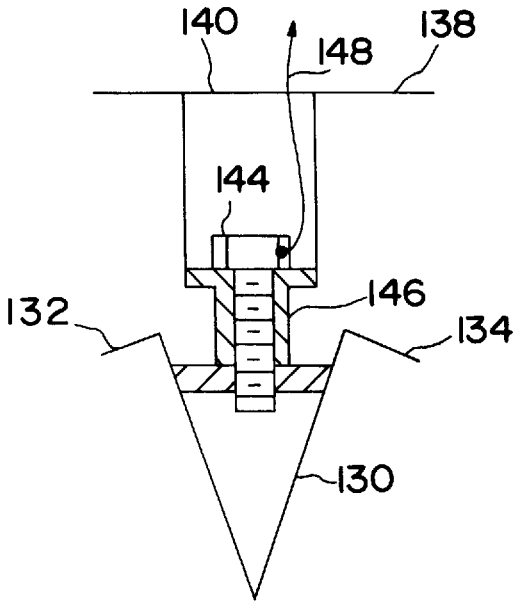
FIG. 9 is a cross-sectional profile schematic of the electron optics of FIGS. 7 and 8 which shows in greater detail how one of the screws is electrically isolated from the electron optics and is also coupled to a single conductive lead for receiving an electrical potential.

FIG. 9 provides more detail of the electrical connection to the single steering electrode 130. Specifically, it shows that the single steering electrode 130 is coupled to a screw 144 which is insulated from the electron optics 138 by an insulator 146 such as a ceramic bushing. However, unlike the embodiment of FIGS. 5 and 6, it is only necessary to provide one conductive lead 148 to one of the screws 144. This is because the single steering electrode 130 needs to have a same electrical potential along its entire length. Finally, operation of this embodiment requires that an electrical potential be applied to the single steering electrode 130 via the lead 148 to thereby adjust the focal point of the electron beams emitted from the cathode cups 132 and 134 so that they are nearer to or further away from the electron optics 138.

It should be apparent that the specific physical configuration of screws and insulating materials required to provide an electrical potential to the single steering electrode 130 disposed between the cathode cups 132 and 134 as shown in FIGS. 7, 8 and 9 is only one possible arrangement. Other similar arrangements should be considered to be within the scope of this invention as defined by the claims which will follow.

In a final alternative embodiment of the present invention, the same principle of providing an electrical field to thereby steer electron beams to a new focal point is shown. However, instead of introducing a new steering electrode, the electrical potential of the electron optics is now used.

Figure 10:
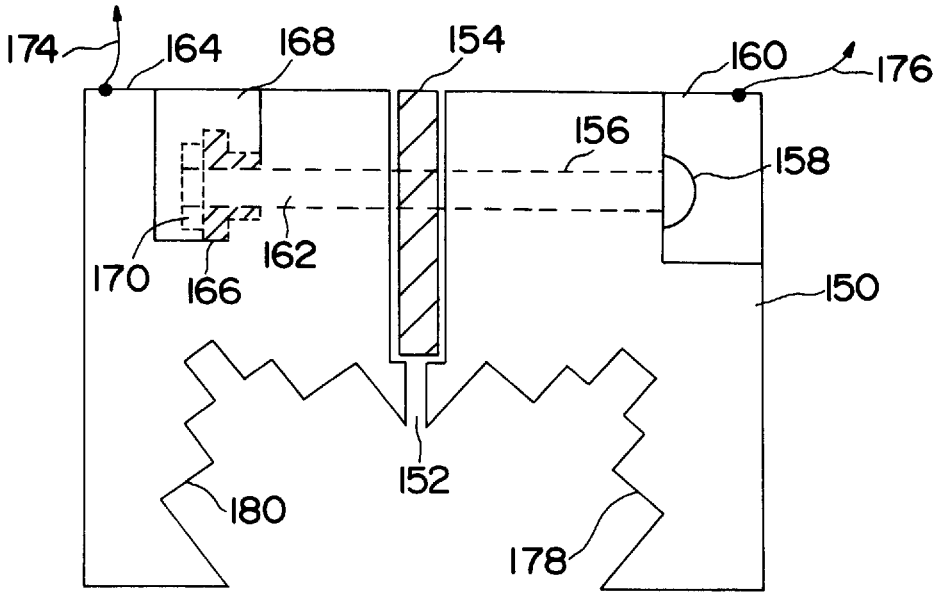
FIG. 10 is an alternative embodiment showing a cross-sectional profile schematic of the electron optics of the cathode assembly, where the electron optics have been separated into two electrically isolated halves using an insulator inserted therebetween.

Specifically, FIG. 10 shows a cross-sectional profile view of the electron optics 150. As this figure shows, the electron optics 150 are now physically separated by a gap 152 which has inserted therebetween an electrical insulator 154 to create two halves. For example, a ceramic material is ideally suited to this purpose. Also shown is an outline of a first screw 156 which holds the two halves of the electron optics 150 together. It should be noted that this first screw 156 must be electrically insulated from one of the halves of the electron optics 150. In this particular embodiment, it was arbitrarily decided to permit contact of a head 158 of the first screw 156 with its half 160 of the electron optics 150. Consequently, an opposite end 162 of the first screw 156 must be electrically isolated from its half 164 of the electron optics 150. This was accomplished through the use of an insulating ceramic bushing 166 inserted into a hole 168 bored into one half 164 of the electron optics 150. A nut 170 is used on the end 162 of the screw 156 to secure it.

Figure 11:
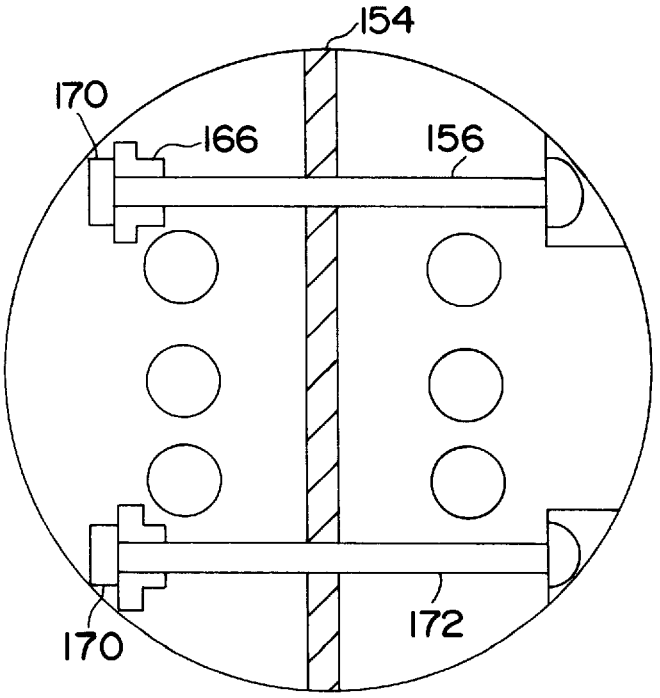
FIG. 11 is a top schematic view of the electron optics shown in FIG. 10, where a second securing screw is shown as being electrically isolated so as not to conduct electricity between the two halves of the electron optics.

Alternatively, the hole 168 can instead be replaced with a depression in the side and top of the electron optics 150 as shown in the views of the screw head 158 in FIGS. 10 and 11. This configuration is probably simpler to construct, especially when the nut 170 is being used to secure the two halves 160 and 164 together.

FIG. 11 is a top view of the electron optics of FIG. 10. To make the electron optics more secure and thus prevent slipping of the two halves 160 relative to each other, it was decided to use a second screw 172 similar in configuration to the first screw 156 as shown.

Operation of the alternative embodiment of FIGS. 10 and 11 is accomplished by creating an electrical potential between the two halves 160 and 164 of the electron optics 150. In other words, an electrical potential can be applied to either half 160 or 164, or both halves. Therefore, it should be realized that a different conductive lead 174 and 176 (see FIG. 10) must be coupled to each half 160 and 164 of the electron optics 150. It is envisioned that a typical electrical potential between the halves could be up to about 300 volts. The cathode cups, 178 and 180 will thus become steering electrodes which can alter the focal point of electron beams generated therefrom.

While the preferred and alternative embodiments of the present invention have utilized the example of a two parallel cathode cup cathode assembly, it is envisioned that the principles of the present invention are equally applicable to other cathode assembly configurations, such as where the cathode cups are not parallel, and where more than two cathode cups are provided. For example, in a tri-focus cathode cup assembly, three cathode cups are disposed in a face thereof. The preferred and alternative embodiments of the present invention are adaptable so as to provide the ability to superimpose electron beams being generated by each of the cathode cups. Accordingly, cathode cup assemblies with more than two cathode cups require only minor modifications by those skilled in the art of X-ray tube manufacturing and utilizing the teachings of the present invention to provide the same electron beam focusing as described above.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An X-ray tube capable of adjusting a focal point of electron beams to thereby superimpose said electron beams generated by a cathode assembly onto an anode assembly comprises:

a vacuum envelope in which is disposed the anode assembly;

a cathode port extending through a wall of the vacuum envelope; and a cathode assembly support structure coupled to the vacuum envelope and the cathode assembly, and including means for selectively adjusting a position of the cathode assembly relative to the anode assembly while partially extending the cathode assembly into the vacuum envelope through the cathode port.

2. The X-ray tube as defined in claim 1, wherein the cathode assembly support structure further comprises:

a fixed support which is coupled to a perimeter of the cathode port;

a movable support which is coupled to a perimeter of the cathode assembly; and a flexible bellows which is coupled at a first end to the fixed support and at a second end to the movable support, thereby enabling the cathode assembly to move relative to the anode assembly while the flexible bellows maintains a vacuum seal between an interior and an exterior of the vacuum envelope.

3. The X-ray tube as defined in claim 2, wherein the cathode assembly support structure further comprises:

a jamb screw disposed in contact with the fixed support and the movable support so as to secure a position of the movable support relative to the fixed support when set, and to enable movement of the movable support relative to the fixed support when loose; and at least one jack screw disposed in contact with the fixed support and the movable support so as to enable precise adjustment of a position of the movable support relative to the fixed support when the jamb screw is loosened.

4. The X-ray tube as defined in claim 3, wherein the cathode assembly support structure further comprises:

the jamb screw disposed so as to be generally aligned along an axis made by a center of the cathode assembly and a bisection of a first cathode filament cup;

a first jack screw disposed so as to be generally aligned along an axis made by the center of the cathode assembly and a bisection of a second cathode filament cup; and a second jack screw disposed so as to be generally aligned along an axis made by the center of the cathode assembly and a bisection of a third cathode filament cup.

5. The X-ray tube as defined in claim 2, wherein the flexible bellows is made of materials selected from the group of materials consisting of nickel, iron, stainless steel, inconel, and other similar alloys having like properties of flexibility and strength.

6. The X-ray tube as defined in claim 2, wherein the X-ray tube further comprises:

a brazed joint between the fixed support and the vacuum envelope which provides a vacuum-tight seal;

a brazed joint between the fixed support and the first end of the flexible bellows, wherein the brazed joint provides a vacuum-tight seal; and a brazed joint between the movable support and the second end of the flexible bellows, wherein the brazed joint provides a vacuum-tight seal.

7. The X-ray tube as defined in claim 2, wherein the X-ray tube further comprises a heli-arc weld joint between the cathode assembly and the movable support which provides a vacuum tight seal.

8. The X-ray tube as defined in claim 2, wherein the flexible bellows is partially expanded by a setting of the jamb screw and the jack screw so as to be generally at a midpoint between fully expanded and fully contracted when the cathode assembly is placed during manufacturing in a position relative to the anode assembly which is considered to enable superimposition of electron beams on the anode assembly prior to adjustment of the jack screw and the jamb screw.

9. A method for electron beam superimposition on a target anode, where an X-ray tube having a plurality of electron beams generated by a cathode assembly are directed at the anode assembly to thereby generate X-rays from a location where the plurality of electron beams strike the anode assembly, said method comprising the steps of:

(1) suspending the cathode assembly over the anode assembly utilizing an adjustable cathode support structure which is capable of moving the cathode assembly generally along a cathode axis; and (2) adjusting a distance between the cathode assembly and the anode assembly utilizing the adjustable cathode support structure, thereby respectively moving a focal point of the plurality of electron beams further from or closer to the anode assembly along the cathode axis.

10. The method as defined in claim 9, wherein the method further comprises the steps of providing the adjustable cathode support structure in a form of a flexible bellows, wherein the flexible bellows can be expanded or contracted to thereby move the electron beams.

11. The method as defined in claim 10, wherein the method further comprises the steps of:

(1) coupling a fixed bellows support to a vacuum envelope disposed around a perimeter of a cathode port through which the cathode assembly partially extends into the vacuum envelope;

(2) coupling a movable bellows support around a perimeter of the cathode assembly;

(3) coupling the flexible bellows in a partially collapsed position to the fixed bellows support and to the movable bellows support; and (4) expanding or contracting the flexible bellows utilizing a set of jamb and jack screws disposed between the fixed bellows support and the movable bellows support.

12. The method as defined in claim 11, wherein the step of expanding or contracting the flexible bellows utilizing a set of jamb and jack screws further comprises the steps of:

(1) disposing the jamb screw so as to be aligned along an axis formed between a center of the cathode assembly and a bisection of a first cathode cup; and (2) disposing each jack screw so as to be disposed along each axis formed between the center of the cathode assembly and each bisection of each remaining cathode cup, thereby enabling precise adjustment of spacing between each cathode cup and the anode assembly.

13. An X-ray tube capable of adjusting a focal point of electron beams to thereby superimpose said electron beams generated by a cathode assembly onto an anode assembly, wherein the X-ray tube comprises:

a cathode face of the cathode assembly directed toward the anode assembly;

a plurality of cathode cups disposed in the cathode face to thereby project a plurality of corresponding electron beams at the anode assembly;

a plurality of insulators disposed on the cathode face, wherein each of the plurality of insulators is disposed adjacent to a corresponding cathode cup;

a plurality of electrodes, wherein each of the plurality of electrodes is disposed on the plurality of insulators and electrically isolated from the cathode face, and capable of developing an electrical potential which can alter a path of each of the plurality of corresponding electron beams; and a plurality of means for delivering a different electrical potential to each of the plurality of electrodes.

14. The X-ray tube as defined in claim 13, wherein the plurality of means for delivering a different electrical potential to each of the plurality of electrodes is comprised of a plurality of conductive wires coupled to a first electrical power source, wherein the first electrical power source is capable of providing the different electrical potentials to each of the plurality of electrodes.

15. The X-ray tube as defined in claim 13, wherein the plurality of insulators disposed on the cathode face are comprised of a ceramic.

16. The X-ray tube as defined in claim 13, wherein the plurality of means for delivering an electrical potential to the plurality of electrodes further comprises:

a first aperture through the cathode assembly from a back side, through the cathode face, and through the first insulator, wherein the first aperture is countersunk to enable a screw to be inserted therein;

a first aperture insulator extending from where the first aperture is countersunk to the first insulator; and a first screw which is inserted into the first aperture, which is electrically isolated from the cathode assembly by the first aperture insulator, and which extends through to the first aperture until making electrical contact with at least one of the plurality of electrodes.

17. The X-ray tube as defined in claim 16, wherein the second means for delivering an electrical potential to the second electrode further comprises:

a second aperture through the cathode assembly from a back side, through the cathode face, and through the second insulator, wherein the second aperture is countersunk to enable a screw to be inserted therein;

a second aperture insulator extending from where the second aperture is countersunk to the second insulator; and a second screw which is inserted into the second aperture, which is electrically isolated from the cathode assembly by the second aperture insulator, and which extends through to the second aperture until making electrical contact with at least a different one of the plurality of electrodes.

18. An X-ray tube capable of adjusting a focal point of electron beams to thereby superimpose said electron beams generated by a cathode assembly onto an anode assembly, wherein the X-ray tube comprises:

a cathode face directed toward the anode assembly;

a first cathode cup disposed in the cathode face of the cathode assembly so as to project a first electron beam at the anode assembly;

a second cathode cup disposed in the cathode face of the cathode assembly so as to project a second electron beam at the anode assembly;

an insulator disposed adjacent to the first cathode cup and the second cathode cup, but so as not to electrically isolate the first and the second cathode cup from each other;

an electrode disposed on the insulator and electrically isolated from the cathode assembly, wherein the electrode is capable of developing an electrical potential which can alter a path of the first electron beam and the second electron beam; and a means for delivering an electrical potential to the electrode.

19. The cathode assembly as defined in claim 18, wherein the X-ray tube further comprises at least one additional cathode cup disposed in the cathode face of the cathode assembly so as to project at least one additional electron beam at the anode assembly, wherein the insulator is also disposed adjacent to the at least one additional cathode cup, and wherein the electrode is also capable of developing an electrical potential which can alter a path of the at least one additional electron beam.

20. The cathode assembly as defined in claim 18, wherein the X-ray tube further comprises means for securing the electrode to the insulator and the cathode assembly, wherein said means comprises:

a first aperture through the cathode assembly from a back side and through the insulator, wherein the first aperture is countersunk to enable a first screw to be inserted therein;

a first aperture insulator extending between where the first aperture is countersunk to the insulator; and a first screw which is inserted into the first aperture, which is electrically isolated from the cathode assembly by the first aperture insulator, and which extends through to the first aperture until making electrical contact with the electrode.

21. The cathode assembly as defined in claim 18, wherein the means for delivering an electrical potential to the first electrode further comprises:

an electrical power source; and an electrical lead which is coupled to the electrical power source and the screw so as to deliver an electrical potential to the electrode.

22. The cathode assembly as defined in claim 20, wherein the cathode assembly further comprises:

a second aperture through the cathode assembly from a back side and through the insulator, wherein the second aperture is countersunk to enable a second screw to be inserted therein;

a second aperture insulator extending between where the second hole is countersunk to the insulator; and a second screw which is inserted into the second aperture, which is electrically isolated from the cathode assembly by the second aperture insulator, and which extends through to the second aperture until making electrical contact with the electrode.

* * * * *